United States Patent [19]

Ugawa et al.

[11] Patent Number: 4,669,221

[45] Date of Patent: Jun. 2, 1987

[54] GLASS STABILIZER ARRANGEMENT FOR AUTOMOTIVE VEHICLE DOOR

[75] Inventors: Satoru Ugawa, Hadano, Japan; Satoshi Obuchi, deceased, late of Fukuoka, Japan, by Fukashi Obuchi, Ruriko Obuchi, legal representatives

[73] Assignee: Nissan Motor Co., Ltd., Yokohama, Japan

[21] Appl. No.: 834,817

[22] Filed: Feb. 28, 1986

[30] Foreign Application Priority Data

Mar. 1, 1985 [JP] Japan ..... 60-40592

[51] Int. Cl.[4] ..... E05F 11/48

[52] U.S. Cl. ..... 49/352; 49/374; 49/375

[58] Field of Search ..... 49/352, 374, 377, 502, 49/227, 375

[56] References Cited

U.S. PATENT DOCUMENTS

| | | | |
|---|---|---|---|
| 2,379,923 | 7/1945 | Roethel | 49/375 |
| 4,110,935 | 9/1978 | Sessa | 49/352 |
| 4,589,227 | 5/1986 | Bickerstaff | 49/352 |

FOREIGN PATENT DOCUMENTS

| | | | |
|---|---|---|---|
| 54-122525 | 8/1979 | Japan . | |
| 58-20516 | 2/1983 | Japan | 49/352 |

*Primary Examiner*—Kenneth Downey

*Attorney, Agent, or Firm*—Schwartz, Jeffery, Schwaab, Mack, Blumenthal & Evans

[57] ABSTRACT

A guide rail assembly of a window regulator is in the form of unit and consists of a pair of parallel guide rails and a plurality of beams extending between the guide rails to interconnect the same. A glass stabilizer for stabilizing a window pane is installed on one of the beams.

2 Claims, 3 Drawing Figures

GLASS STABILIZER ARRANGEMENT FOR AUTOMOTIVE VEHICLE DOOR

BACKGROUND OF THE INVENTION

1. Field of the Invention

The present invention relates in general to automotive vehicle doors and more particularly to an arrangement of a glass stabilizer for stabilizing a door glass or window pane of an automotive vehicle door.

2. Description of the Prior Art

A glass stabilizer is widely used in an automotive vehicle door, particularly of the frameless type for stabilizing a door glass, i.e., for preventing the upper portion of the door glass from swinging in the vehicle width direction during upward and downward movement of the door glass or when the door glass is in a half open position or in a fully open position.

An example of a prior art glass stabilizer is shown in FIG. 3 in which the reference numeral 1 indicates a door main body consisting of a door inner panel 2 and a door outer panel 3 which are joined to have a closed section. A door glass 4 is accommodated in the door main body 3 in such a manner as to be movable upwardly and downwardly being driven and guided by an unshown window regulator. A glass stabilizer is generally indicated by the reference numeral 5 and installed in the door main body 1 at a location adjacent a door waist opening 1*a* through which the door glass 4 moves outward or inward of the door main body 1. The glass stabilizer 5 consists of a base member 6 secured to a bracket 8 which is in turn secured to an upper end portion of the door inner panel 2 with a bolt and nut 9 and a roller 7 rotatably mounted on the base member 6 in such a manner as to rollingly contact the window glass 4. A bolt accommodation hole of either of the above described base member 6 or bracket 8 is formed into an elongated hole which is elongated in the vehicle width direction so that the location of the vehicle stabilizer 5 is adjustable in the vehicle width direction. A glass stabilizer arrangement similar to the above is for example shown in the Japanese Provisional Utility Model Publication No. 54-12252.

A disadvantage of the above described prior art glass stabilizer arrangement is that the glass stabilizer 5 needs to be installed on the door inner panel 2 after installation of the window regulator and then to be adjusted in location so as to compensate for some errors in installation of the window regulator, resulting in that the installation of the glass stabilizer 5 requires a long time. Another disadvantage is that due to the necessity of a reinforcement member 10 in addition to the bracket 8, the number of necessary constituent parts is increased to inevitably increase the cost and the weight. A further disadvantage is that a large part of the narrow limited interior space of the door main body 1 is occupied by the bracket 8 and the reinforcement member 10, causing a difficulty of arrangement and layout thereof in order to prevent them from interfering with other parts disposed within the door main body 1, resulting in increased restrictions on design of the door main body 1 as well as the glass stabilizer 5.

SUMMARY OF THE INVENTION

In accordance with the present invention, there is provided a novel and improved glass stabilizer arrangement for an automotive vehicle door which comprises a window regulator including a guide rail fixedly attached to a door inner panel of the automotive vehicle door, the guide rail assembly being in the form of a unit and having a pair of parallel guide rails spaced from each other and a plurality of beams extending between the guide rails to integrally interconnect the same, a window pane movably guided by the guide rails, and a glass stabilizer installed on one of the beams and in rolling contact with the window pane.

The above structure is quite effective for overcoming the above noted disadvantages inherent in the prior art arrangement.

It is accordingly an object of the present invention to provide a novel and improved glass stabilizer arrangement for an automotive vehicle door which makes it possible to install a glass stabilizer without requiring any delicate adjustment and therefore with ease.

It is a further object of the present invention to provide a novel and improved glass stabilizer arrangement of the above described character which can reduce the cost and the weight.

It is a further object of the present invention to provide a novel and improved glass stabilizer arrangement of the above described character which can reduce the restrictions on design of the automotive vehicle door as well as the glass stabilizer.

BRIEF DESCRIPTION OF THE PREFERRED EMBODIMENT

The features and advantages of the glass stabilizer arrangement of the present invention will become more clearly appreciated from the following description taken in conjunction with the accompanying drawings, in which.

DETAILED DESCRIPTION OF THE PREFERRED EMBODIMENT

Figure 1:
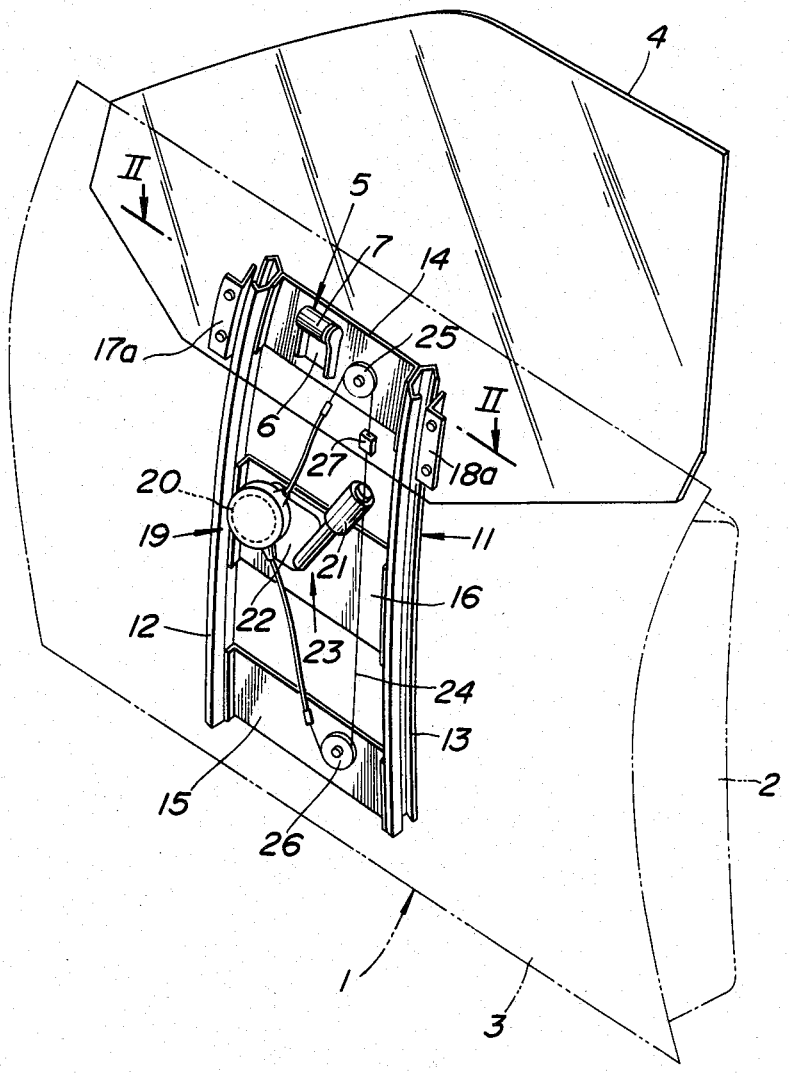
FIG. 1 is a perspective view of a glass stabilizer arrangement according to an embodiment of the present invention.
Figure 2:
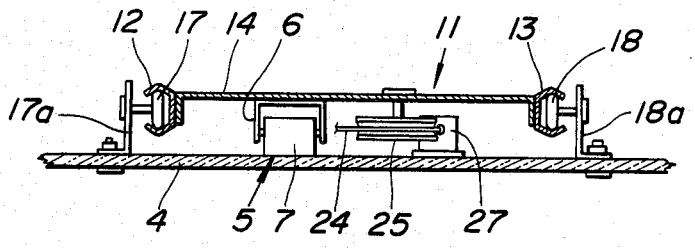
FIG. 2 is a sectional view taken along the line II—II of FIG. 1.
Figure 3:
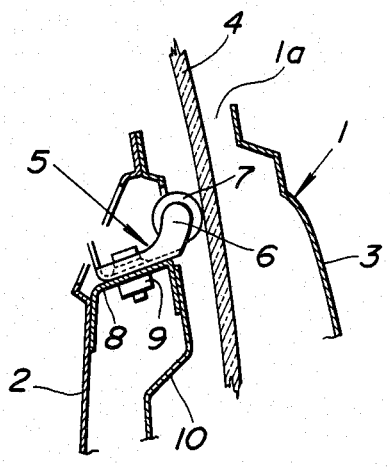
FIG. 3 is a fragmentary sectional view of a prior art glass stabilizer arrangement.

Referring to FIGS. 1 and 2, in which like or corresponding parts to those of the prior art arrangement of FIG. 3 are designated by like reference characters, generally indicated by the reference numeral 11 is a guide rail assembly of a window regulator disposed within a door main body 1 and secured to a door inner panel 2. The guide rail assembly consists of a pair of parallel guide rails 12, 13 disposed nearly vertically or disposed to extend in the roof-to-floor direction of the vehicle and a plurality of beams, as for example an upper beam 14, lower beam 15 and middle beam 16, disposed between the guide rails 12, 13 to integrally interconnect the same, i.e., the upper beam 14 interconnects the upper end portions of the guide rails 12, 13, the lower beam 15 interconnects the lower end portions, and the middle beam 16 interconnects the middle portions intermediate between the upper and lower end portions. The guide rail assembly 11 is formed into a one-piece unit as above prior to installation on the door inner panel 2.

With the guide rails 12, 13 a pair of guide rollers 17, 18 are movably engaged and which are in turn rotatably mounted through brackets 17*a*, 17*a* on the door glass 4 so that upward and downward movement of the door glass 4 is guided by the guide rails 12, 13.

A wire type drive unit for driving the door glass 4 is generally indicated by the reference numeral 19. The drive unit 19 is of the conventional type and consists of a winding drum 20 rotatably mounted on the middle beam 16, a pair of pulleys 25, 26 rotatably mounted on the respective upper and lower beams 14, 15, a movable bracket 27 secured to the door glass 4 to move together therewith, a wire 24 having a portion fixedly attached to the movable bracket 27 and placed around the pulleys 25, 26 and the winding drum 20 in such a manner as to have opposite end portions which are respectively wound around the winding drum 20 in the reverse directions, and an electric motor 21 for driving the winding drum 20 in one and the other directions by way of a reduction gear 22.

A glass stabilizer 5 consisting of a base member 6 and a roller 7 is fastened with a bolt and nut (not shown) or otherwise secured to the upper beam 14 in such a manner that the roller 7 is brought into rolling contact with the door glass upon assembly of the window regulator and the door glass 4.

In operation, the drive unit 19 is actuated to cause the winding drum 20 to rotate in one or the other direction, with the upper portion of the wire 24 being wound up on the winding drum 20 or being wound off from same. By this, the movable bracket 27 is caused to move upwardly or downwardly between the pulleys 25, 26, with the door glass 4 being driven to move upwardly and downwardly. In response to movement of the door glass 4, the roller 7 of the glass stabilizer 5 is caused to rotate while preventing the door glass 4 from swinging in the vehicle width direction.

From the foregoing, it is to be understood that the glass stabilizer 5 does not require any delicate adjustement upon installation and therefore can be installed with ease since it is adapted to be installed on the guide rail assembly 11 prior to installation of the guide rail assembly on the door inner panel 2 and therefore its location relative to the door glass 4 is not affected by any errors in installation of the window regulator.

It is further to be understood that the glass stabilizer arrangement of the present invention is quite effective for reducing the cost and the weight since the bracket 8 and the reinforcement 10 otherwise necessitated can be dispensed with.

It is yet further to be understood that since the bracket and reinforcement member employed in the prior art arrangement can be dispensed with, it becomes possible to reduce restrictions on design of the automotive vehicle door as well as the glass stabilizer.

What is claimed is:

1. A glass stabiizer arrangement for an automotive vehicle door having a door inner panel, comprising:

a window regulator comprising a guide rail assembly fixedly attached to the door inner panel, said guide rail assembly being in the form of an integral unit and comprising a pair of parallel guide rails disposed nearly vertically and spaced from each other, an upper beam interconnecting upper end portions of said guide rails, a lower beam interconnecting lower end portions of said guide rails and a middle beam interconnecting portions of said guide rails intermediate between said upper end portions and said lower end portions;

a window pane movably guided by said guide rails;

a glass stabilizer installed on said upper beam and in rolling contact with said window pane, said glass stabilizer comprising a base member secured to said upper beam and a roller rotatably mounted on said base member; and said window regulator further comprising a pair of rollers movably engaged in said guide rails and rotatably mounted on said window pane, a winding drum rotatably mounted on said middle beam, a pair of pulleys rotatably mounted on said upper and lower beams, respectively, a movable bracket attached to said window pane to move together therewith, a wire having a portion fixedly attached to said bracket and placed around said pulleys and said winding drum in such a manner as to have opposite end portions which are respectively wound around said winding drum in reverse directions, and means for driving said winding drum to rotate.

2. A glass stabilizer arrangement as set forth in claim 1, in wherein said driving means comprises an electric motor and a reduction gear mounted on said middle beam.

* * * * *